United States Patent [19]

Bianchi et al.

[11] 4,163,598

[45] Aug. 7, 1979

[54] POINT-TO-POINT MINIATURE COAX CONNECTOR

[75] Inventors: Edward A. Bianchi; John H. Huber, both of Harrisburg, Pa.

[73] Assignee: AMP Incorporated, Harrisburg, Pa.

[21] Appl. No.: 906,534

[22] Filed: May 17, 1978

[51] Int. Cl.[2] ..... H01R 13/58

[52] U.S. Cl. ..... 339/107; 339/18 B; 339/217 S

[58] Field of Search ..... 339/107, 18 B, 99 R, 339/128, 217 S, 217 R, 217 TF

[56] References Cited

U.S. PATENT DOCUMENTS

| | | | |
|---|---|---|---|
| 3,500,292 | 3/1970 | Enright et al. | 339/97 R |
| 3,836,944 | 9/1974 | Lawson | 339/99 R |
| 3,864,010 | 2/1975 | Wasserlein, Jr. | 339/97 R |
| 3,879,099 | 4/1975 | Shaffer | 339/99 R |
| 3,899,236 | 8/1975 | Santos | 339/98 |
| 3,963,319 | 6/1976 | Schumacher et al. | 339/176 MF |

*Primary Examiner*—Roy Lake
*Assistant Examiner*—DeWalden W. Jones
*Attorney, Agent, or Firm*—Gerald K. Kita

[57] ABSTRACT

The disclosure relates to an assembly of electrical contacts with a center conductor and a ground conductor on a coaxial cable, the assembly including further a one-piece housing having two parts hinged to each other for closure together, thereby terminating the conductors to the contacts and providing an enclosure for the terminated conductors. The contacts protrude from the housing for pluggable connection into apertures of a printed circuit board.

2 Claims, 8 Drawing Figures

POINT-TO-POINT MINIATURE COAX CONNECTOR

FIELD OF THE INVENTION

The invention relates to miniaturized connectors for individual coaxial cables which allow individual pluggable connection of the cables point-to-point in a plug board or apertured circuit board.

BACKGROUND OF THE INVENTION

Typical coaxial patchcord assemblies and plug boards are exemplified in U.S. Pat. Nos. 3,284,755, 3,341,801, and 3,335,388. These systems are designed for making board to board interconnections with a front board being preprogrammed with coaxial patchcords point-to-point. The front board is then plugged into a rear board with all of the preprogrammed patchcords being simultaneously interconnected with the boards. The coaxial patchcords are individually provided with very carefully machined connector elements. A typical connnector element, shown in U.S. Pat. No. 3,284,755, includes a smooth noise pin portion connected to the coaxial cable center conductor. The pin is encircled by a sleeve of dielectric material, which, in turn, is encircled by a conducting sleeve, also smooth and having resilient spring properties to allow retention in a corresponding aperture of a front board. Such a connector element is expensive to manufacture and assemble onto a coaxial cable. There has been a long existing need for an economical coaxial connector for point-to-point use without having to resort to patchcord connector elements.

BRIEF DESCRIPTION

According to the present invention, a point-to-point suitable connector for coaxial cable includes a single piece molded housing having a base and an integral cover which are hinged to each other and which close together to forcibly insert a center conductor and a drain wire conductor of the coaxial cable into corresponding slitted plate contacts. The contacts include protruding nose portions which are provided with resilient rolling beams or blades which protrude from the housing for pluggable connection into an apertured substrate such as a circuit board or a plug board. The rolling beams provide for resilient retention of the contacts in the apertured circuit board or plug board without having to resort to machined parts. The contacts are sheared to provide slits which are assembled electrically to the cable simultaneously upon closure of the housing, thereby eliminating the complex concentric sleeve and pin connections of a patchcord.

Accordingly, an object of the present invention is to provide a coaxial cable connector whereby assembly of electrical contacts to the center conductor and ground wire conductor is accomplished upon closure of a housing.

Another object of the present invention is to provide a coaxial cable connector utilizing slit plate contacts which are assembled electrically to the center conductor and ground wire conductor of a coaxial cable simultaneously with closure of an enclosing dielectric housing, the contacts further including rolling beam nose portions which provide resilient retention in an apertured substrate.

Other objects and many advantages of the present invention will become apparent from a following detailed description taken in conjunction with the drawings.

DETAILED DESCRIPTION

Figure 1:
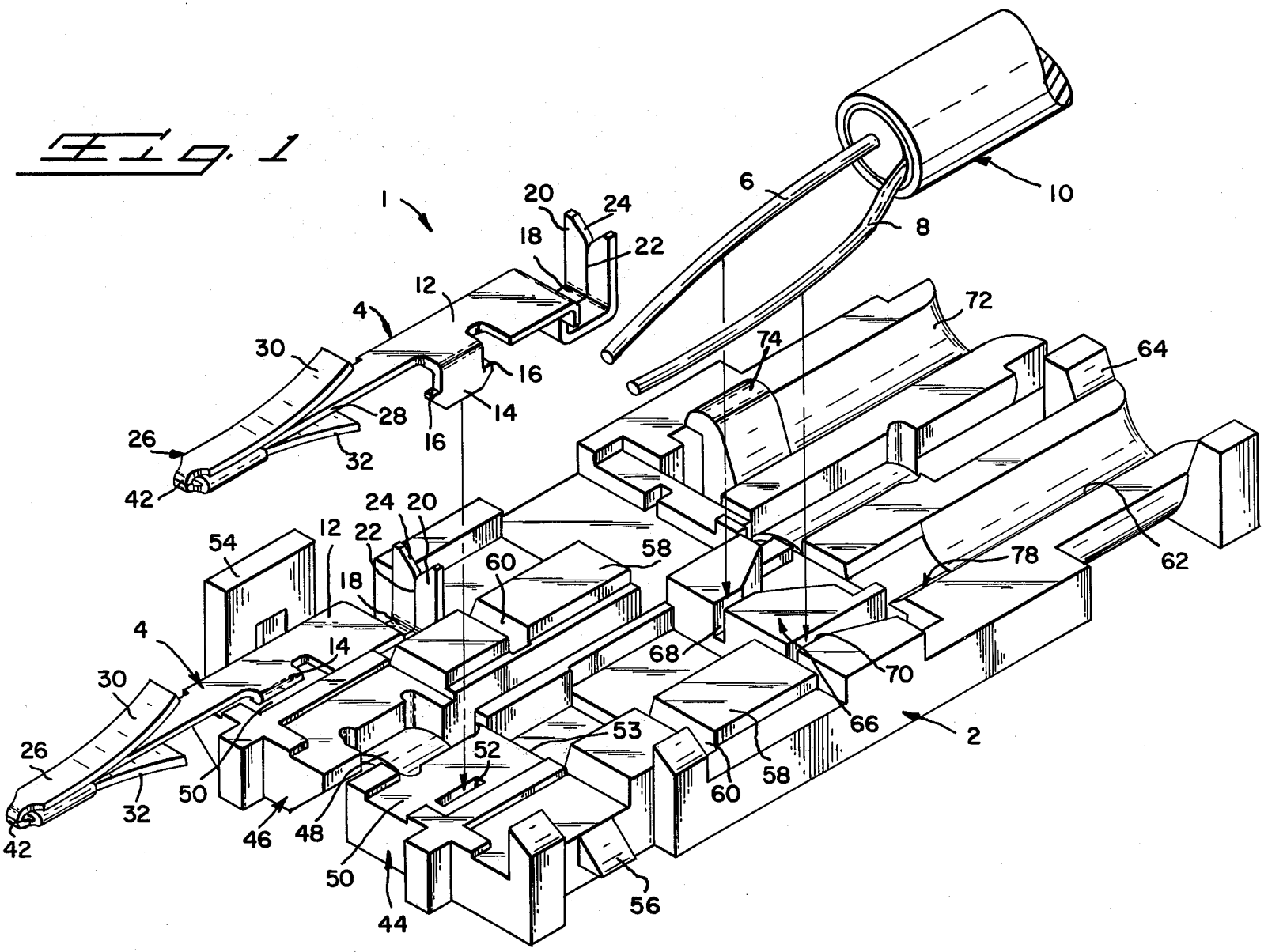
FIG. 1 is an enlarged fragmentary perspective with parts exploded to illustrate the details of a preferred embodiment according to the present invention.
Figure 2:
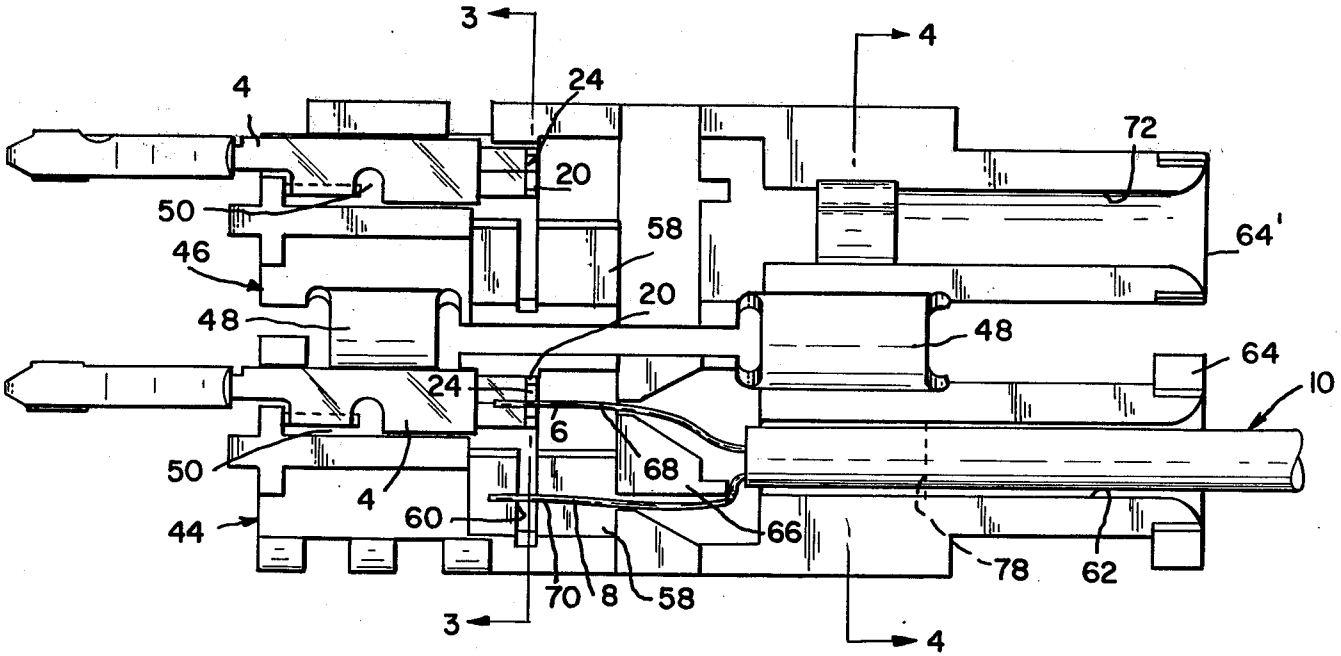
FIG. 2 is a top plan view of the embodiment shown in FIG. 1 with the parts assembled prior to closure and termination of the contacts and conductors.
Figure 3:
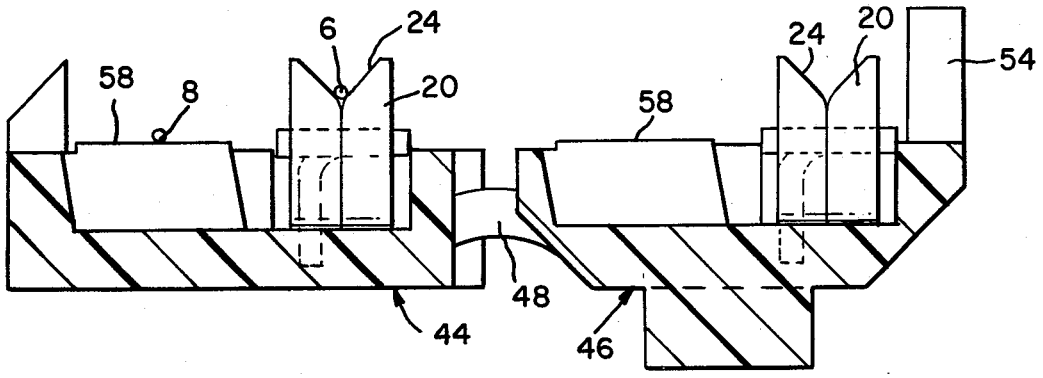
FIG. 3 is a section taken along the lines 3—3 of FIG. 2.
Figure 3A:
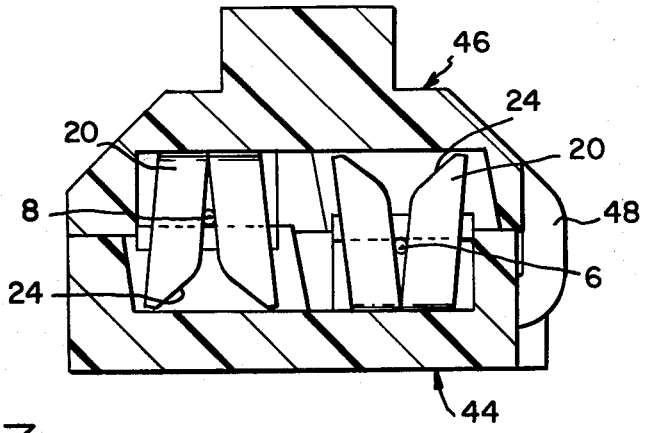
FIG. 3A is a section similar to FIG. 3 with the parts completely assembled.

With more particular reference to FIGS. 1 and 2 of the drawings, there is illustrated generally at 1 a preferred embodiment of a point-to-point coaxial connector according to the present invention. The connector includes a two piece dielectric housing 2 in which are mounted a pair of identical electrical contacts 4 for connection respectively to a center conductor 6 and a drain wire conductor 8 of a coaxial cable illustrated generally at 10. Each contact 4 is stamped and formed in one piece from relatively thin metal strip and is provided with a central elongated planar body portion 12 having an integral tab 14 bent to project outwardly from the plane of the body portion in depending relationship therefrom. The tab 14 is provided with a pair of projecting barbs 16. One end portion of the contact 4 is bent into a shallow U-shaped configuration at 18. A free end 20 projects outwardly above the plane of the body portion 12 and is bifurcated by a shear 22 extending through the free end portion and at least partially along the U-shaped configuration 18. The shear 22 is of extreme narrow width and opens into an outwardly flared notch 24 in the free end 20. As will be explained hereafter, electrical termination of either conductors 6 or 8 is made by forcible insertion thereof into a corresponding slitted free end 20 of a terminal 4.

Each terminal 4 further includes an opposite end or nose portion 26 having a central elongated planar blade portion 28 flanked by a pair of blade portions 30 and 32 which flank opposite planar surfaces of the blade portion 28. The flanking blade portions 30 and 32 are outwardly flared toward their free ends from the central blade portion 28 and serve as rolling beam contacts to provide resilient retention of the nose portion in an aperture of a substrate such as a printed circuit board for pin board.

Figure 6:
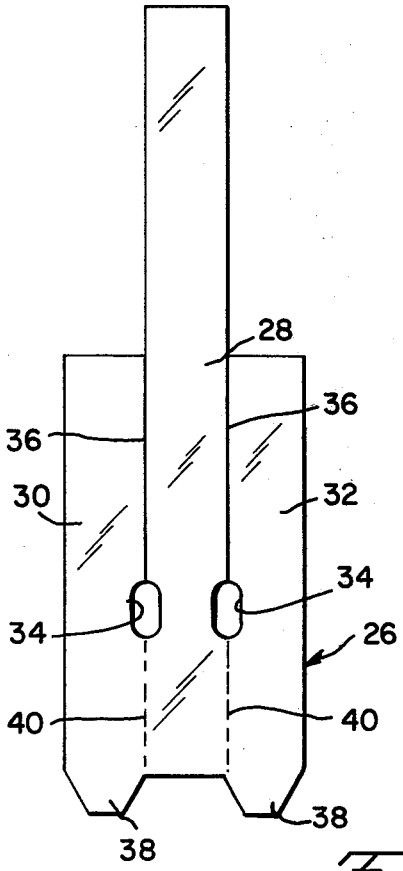
FIG. 6 is a fragmentary plan of a blank from which a contact is formed.

The nose portion 26 is fabricated by stamping out a metal blank, shown in FIG. 6 as having a width at least equal to the combined widths of the portions 28, 30, and 32. A pair of identical apertures 34 are stamped in the blank. The blank is then sheared lengthwise in two places as shown at 36 to define the three blade portions 28, 30, and 32 in side-by-side relationship. The shear lines 36 end and communicate with the apertures 34. The free end of the blank is formed into a pair of frusto-triangular projections 38 which are aligned lengthwise with the blade portions 30 and 32. The blank is then folded along the dotted lines 40 in opposite directions so that the blade portions 30 and 32 flank opposite sides of the central blade portion 28. Before folding, the blade portions 30 and 32 are bent to their flared configurations. Also, the frusto-triangular nose portions 38 are bent to form a blunted, smoothly rounded nose portion, illustrated generally at 42 in FIG. 1.

Yet with reference to FIG. 1 the housing 2 is molded of dielectric material, initially bifurcated longitudinally into a base 44 and a cover 46 integrally joined together by a pair of spaced, flexible and integral hinges 48. The base and cover each is provided with a planar bearing surface 50 upon which a corresponding body portion 12 is received. A narrow rectangular recess 52 is provided in each bearing surface 50 for pluggable receipt therein of a corresponding tab 14. The barbs 16 of each tab 14 lockingly engage the housing material and retain the tab within a corresponding recess 52. Immediately tandem of each bearing surface 50 is provided a recess 53 which receives therein a corresponding U-shaped portion 18 of a terminal 4. The cover portion 46 is provided laterally of the bearing surface 50 with a projecting hasp 54. The base 44 is provided laterally of the bearing surface 50 with an inclined ramp, projecting latch 56. The housing is designed for closure together of the base 44 and cover 46 by bending the flexible hinges 48. To retain the housing in a closed configuration, the latch 56 will lockingly register with the hasp 54.

As shown in FIGS. 1 and 2, an electrical contact 4 is mounted, one in the cover and another in the base. Both the base and the cover are provided each with a corresponding projecting planar table 58 which is transversely slotted or recessed at 60 for receiving a corresponding free end 20 of a contact therein upon closure together of the housing base and cover. Each table 58 further is utilized to engage a length of a corresponding conductor 6 or 8 to laterally support the same and to urge the same into a slitted contact portion 20 upon closure together of the base and cover. As shown in FIGS. 1 and 2, the coaxial cable 10 is assembled initially into an elongated semi-cylindrical cavity 62 which communicates with an end 64 opposite the end from which the nose portions 26 of the contacts protrude. As shown, the cable 10 is prepared by cutting away portions thereof to expose lengths of the conductors 6 and 8. The base 44 is provided with an integral projecting wire alignment barrier block 66 having a pair of spaced narrow channels 68 and 70 through which the wires 6 and 8 are threaded. As shown in FIG. 2, the center conductor 6 is laid in the channel 68 and is laid initially in the notch portion 24 of the corresponding terminal 4. The drain wire 8 is laid in the channel and overlies the table 58 and the contact receiving slot 60 provided therein. The cover 46 is provided with a semi-cylindrical cavity 72 also communicating with an end 64' opposite the end from which the corresponding contact 4 protrudes. When the base 44 and cover 46 are closed together the cable 10 will be encircled by and received within the cavities 72 and 62. In addition, the corresponding table portions 58 will laterally support the corresponding conductors 6 and 8 and laterally urge and insert them into the slitted contact portions 22 as the contact portions 20 pass through the table for receipt into corresponding slots 60. The conductors thereby are terminated to corresponding contacts 4 simultaneously upon closure of the housing. The notch portions 24 of the contacts provide a large funnel entry to insure that the wires are guided into the slitted portions 22. The contact receiving cavities 60 are of narrow width to prevent buckling of the wires as they are forcibly received in corresponding contacts.

Figure 4:
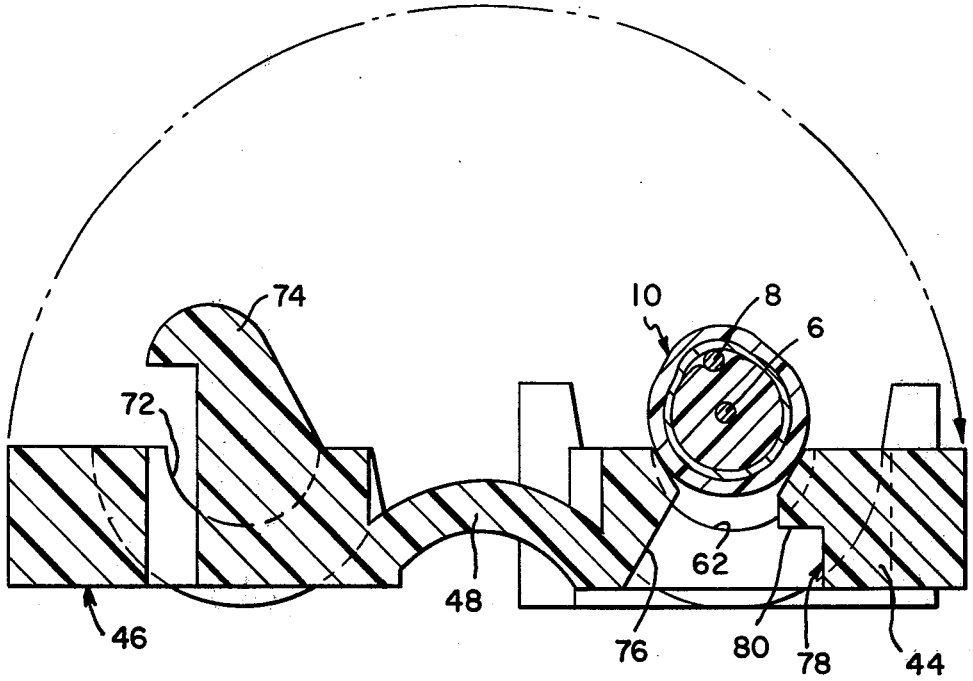
FIG. 4 is a section taken along the line 4—4 of FIG. 2.
Figure 4A:
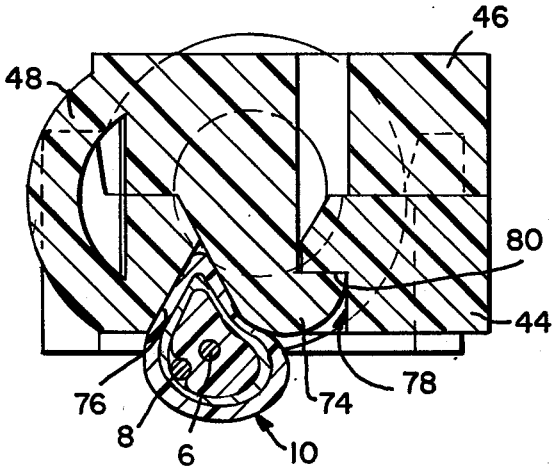
FIG. 4A is a section similar to FIG. 4 with the parts completely assembled.

As shown more particularly in FIGS. 1, 4, and 4A, the cover 46 is provided with an integral projecting hook portion 74 projecting outwardly from the cable receiving cavity 72. Upon closure of the housing, the hook portion 74 will enter the cable receiving cavity 62 of the base 44, forcibly deforming the cable 10, as shown in FIG. 4A. The cable 10 will be compressed between the hook portion 74 and a side wall 76 of a cavity 78 which opens laterally in the base 44 and communicates with the cable receiving cavity 62. The hook 74 lockably registers against an undercut surface 80 of the cavity 72 to lockingly retain the housing and cover together and to maintain a compressed gripping pressure on the deformed cable 10. As shown greatly exaggerated in FIG. 4, the cable 10 will partially protrude outwardly of the cavity 78. Due to the compactness of the assembly the cable is required to protrude slightly to make room for closure and electrical termination of the parts as described. The illustrations are approximately fifteen times the actual scale of the parts. Due to a requirement for compactness and the inherent small size of the component parts the described deformation and partial protrusion of the cable 10 is required to anchor the cable against pull out from the assembly.

Figure 5:
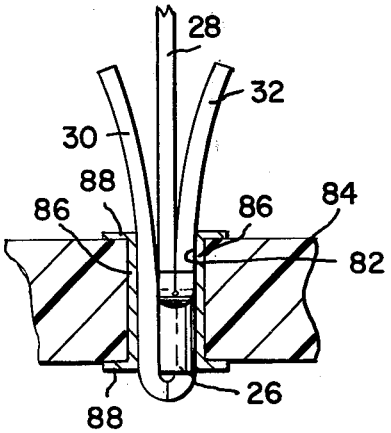
FIG. 5 is an enlarged fragmentary elevation in section of a connection in a printed circuit board substrate.

As shown more particularly in FIG. 5, the nose portion 26 is illustrated as inserted within an aperture 82 of a substrate 84 may be a circuit board as illustrated or, alternatively, a pin board. The aperture 8 is lined with plating 86, which plating also forms a ring 88 at each end of the aperture 82. As the nose 26 is progressively inserted into the aperture 82, the flanking beams 30 and 32 will be progressively stuffed into the aperture 82, and as a consequence, will be flattened progressively against the central blade portion 28 by a rolling action. Such flattening of the blades by a rolling action produces stored resilient energy in the flanking blades which provides for resilient retention of the nose portion 26 in the aperture 82. Advantageously, the resilient action is adaptable to a wide range of aperture diameters and eliminates the need for a precisely machined nose portion as would be required by a conventional coaxial patchchord assembly. The contact is reuseable and no damage to it or the aperture results despite repeated plug ins and removals.

Although a preferred embodiment of the present invention has been disclosed, other embodiments and modifications thereof which would be apparent to one having ordinary skill in the art are intended to be covered by the spirit and scope of the appended claims.

What is claimed is:

1. In a container for attachment to a coaxial cable having a pair of electrical contacts secured respectively to a center conductor and a ground conductor of the cable and adapted for pluggable conection into a matrix of substrate apertures lined with conductive material, the improvement comprising:

a dielectric housing formed in two sections hinged together for enclosure on said cable, each contact having a slit plate conductor receiving portion and a portion protruding from said housing in the form of a central blade flanked on either side by spring blade portions integrally joined to said center blade and flaring outwardly toward their free ends away from said center blade, whereby both flanking blades are progressively flattened from their flaring configurations flatly against said center blade upon pluggable connection of said contact protruding portions into said substrate apertures.

2. The structure as recited in claim 1, wherein, one section of said connector includes a side opening having an undercut surface, the other section of said connector includes a latch portion entering said opening and lockably engaged with said undercut surface, said cable being displaced into said opening by said latch and being compressibly gripped by said latch and against a side wall of said opening.

* * * * *

UNITED STATES PATENT OFFICE

CERTIFICATE OF CORRECTION

Patent No. 4,163,598 Dated August 7, 1979

Inventor(s) Edward A. Bianchi and John H. Huber

It is certified that error appears in the above-identified patent and that said Letters Patent are hereby corrected as shown below:

Column 4, line 55, "container" should read - - - connector - - -.

Signed and Sealed this

*Fourth* Day of *December 1979*

[SEAL]

*Attest:*

SIDNEY A. DIAMOND

*Attesting Officer*

*Commissioner of Patents and Trademarks*